United States Patent [19]

Patton

[11] 3,972,782

[45] Aug. 3, 1976

[54] EMISSION CONTROL APPARATUS

[76] Inventor: James D. Patton, 9480 Olive Blvd., St. Louis, Mo. 63132

[22] Filed: Dec. 4, 1974

[21] Appl. No.: 529,288

[52] U.S. Cl. ..... 202/263; 55/319

[51] Int. Cl.[2] ..... C10B 27/04

[58] Field of Search ..... 202/263, 262, 227–230; 55/319, 418; 201/39, 40; 98/115

[56] References Cited

UNITED STATES PATENTS

| | | | |
|---|---|---|---|
| 930,947 | 8/1909 | Edison | 55/319 |
| 1,544,950 | 7/1925 | Smith | 55/DIG. 25 |
| 3,396,514 | 8/1968 | Hurst | 98/115 |
| 3,675,400 | 7/1972 | Kubsch | 202/263 |
| 3,739,557 | 6/1973 | Anderson | 55/319 |
| 3,820,307 | 6/1974 | Hausberg | 55/319 |
| 3,844,901 | 10/1974 | Roe | 202/263 |
| 3,879,267 | 4/1975 | Nashan | 202/263 |
| 3,883,324 | 5/1975 | Balla | 55/418 |

*Primary Examiner*—Hiram H. Bernstein
*Attorney, Agent, or Firm*—Koenig, Senniger, Powers and Leavitt

[57] ABSTRACT

Apparatus and method for controlling emissions caused by pushing of coke from a coke oven. The apparatus includes an entrapment chamber extending alongside a plurality of ovens for containing the emission. Exhaust means for the entrapment chamber comprises a flow path restriction for accelerating gases leaving the entrapment chamber so that particulates are entrained in the gases and inhibited from settling in the entrapment chamber. Gas velocity is reduced in an expansion chamber downstream from and extending below the level of the flow restriction. The expansion chamber provides a settling region laterally offset from said flow restriction in which particulates fall out of the gases along a settling path whose gravity component is in a direction downstream from the entrapment chamber. The particulates which separate from the gases are collected in solids receiving means below the settling region and the gases leave the apparatus through exhaust means downstream from the expansion chamber and the solids receiving means. The flow restriction, settling region and apparatus exhaust means are in series relationship so that substantially the entire mass of the emission passes through the settling region.

10 Claims, 4 Drawing Figures

EMISSION CONTROL APPARATUS

BACKGROUND OF THE INVENTION

This invention relates to the field of air pollution control and, more particularly, to an improved apparatus and method for controlling the emissions caused by the pushing of coke from coke ovens.

The discharge of coke from a coke oven presents an exceptionally difficult and offensive air pollution problem. When the coke at a temperature of ~ 2,000°F. is suddenly discharged from the oven into the waiting quench car, there is a massive release of heat to the surroudings. This heat release causes an emission in the form of a rapid and voluminous updraft containing significant amounts of particulates picked up from the coke. Subsequent fallout of these particulates from the emission scatters solid pollutants over neighboring areas extending a substantial distance from the coke oven battery. The emission also includes noxious gases emanating in part from discharge of the oven and formed in part by partial combustion at the surface of the glowing coke between carbon of the coke and oxygen from the surrounding air. These noxious gases may present a hazard to the workmen positioned on the discharge side of the oven.

Various devices have been proposed in the art for the control of the emission produced upon the pushing of coke from a coke oven. Most of these devices have included traveling hoods adapted to be positioned over either the coke guide or the quench car. Such a hood has typically been provided with a blower for removal of gases therefrom and a scrubber or other means for separation of the particulates from the gases. The effectiveness of such emission control systems has been very limited since the volume of the hood is generally inadequate to contain the rapid flow surge which is produced as the oven is pushed. As a consequence, a substantial portion of the gases and particulates tend to escape and pollute the surrounding area. Given the limited volumetric capacity of these traveling hoods, such problems could be overcome only by providing an exceptionally high capacity exhaust system for the hood. This factor, together with the high energy scrubbing system needed to remove the high particulate load in the gases exhausted from the hood, requires a very high power consumption, for example, on the order of 2,000–3,000 hp. Where a traveling hood has been designed and adapted to cover areas within which workmen may be stationed, moreover, the hood tends to confine and concentrate noxious gases, presenting a serious hazard to the workmen. Because of their size, weight and mechanical complexity and the severe environment in which they are used, traveling hoods are not only expensive to install, but are also subject to potentially serious maintenance problems with attendant downtime and repair expense.

Many of the serious problems encountered with traveling hoods have been resolved by the stationary emission control shed described in Roe and Patton U.S. Pat. No. 3,844,901. In this system, a peaked roof shed extending along the length of the coke side of the battery includes an entrapment zone adjacent the oven discharge doors, a throat above the entrapment zone for acceleration of the gases, an expansion and collection chamber above the throat where some of the particulates are deposited and collected, and an exhaust duct in the apex of the peaked roof for removal of the gases from the shed. In the collection chamber, the gas flow reaches the underside of the peaked roof and is then turned down to cause recirculation and cooling of gases directly above shelflike portions extending outwardly from either side of the throat. Particulates separate from the gases and fall out on the surfaces of these shelflike portions.

Although the system described in the aforesaid patent is substantially superior to those systems previously known, it does not prevent fallout, often appreciable, of particulates back into the coke car track area. As the particulates separate from the gases in the collection chamber, they are falling back in the direction of the entrapment chamber. Not all of these particulates collect on the shelves on either side of the throat, and those which do not collect on the shelves normally find their way back onto the tracks or the working area on the coke side of the battery. A problem is also presented by the accumulation of solids on the shelflike areas on either side of the throat. This accumulation must be periodically removed, and the removal process is normally a dirty and potentially hazardous manual operation. Despite the material improvement in coke oven emission control afforded by the process of U.S. Pat. No. 3,844,901, therefore, a further need has existed for improved emission control systems which substantially eliminate fallout of particulates in the track or working areas, and which provide positive collection and removal of solid particulates from the system.

SUMMARY OF THE INVENTION

Among the several objects of the present invention, therefore, may be noted the provision of an improved apparatus and method for the control of emissions on the coke side of a coke oven battery; the provision of such a system which will contain the emission even at the peak of the thermal and volumetric surge experienced during the pushing of coke from an oven; the provision of such a system which is relatively economical to install and also free of the severe maintenance problems often incurred with traveling hood systems; the provision of such a system which prevents fallout of particulates back onto the track or working areas; the provision of such a system which affords positive collection of solids; the provision of such a system from which solids can be consistently removed without the requirement of dirty and hazardous manual labor; and the provision of such a system which operates without excessive power consumption. Other objects and features will be in part apparent and in part pointed out hereinafter.

Briefly, therefore, the present invention is directed to apparatus installed on the coke side of a coke oven battery for controlling emissions caused by the pushing of coke from a coke oven. The apparatus includes an entrapment chamber extending alongside a plurality of ovens for containing the emission. Exhaust means for the entrapment chamber comprise a flow path restriction for accelerating gases leaving the entrapment chamber so that particulates are entrained in the gases and inhibited from settling in the entrapment chamber. Gas velocity is reduced in an expansion chamber downstream from and extending below the level of the restriction. The expansion chamber provides a settling zone laterally offset from said flow restriction in which the particulates fall out of the gases along a settling path whose gravity component is in a direction downstream from the entrapment chamber. Below the settling zone are solids receiving means for collection of the particulates separating from the gases, and downstream from the solids receiving means and the expansion chamber are gas exhaust means for the apparatus. The flow restriction, settling region, and apparatus exhaust means are in series relationship so that substantially the entire mass of the emission passes through the settling region.

In a more particular aspect, the invention is directed to apparatus installed over the quenching car tracks on the coke side of a coke oven battery for controlling emissions caused by the pushing of coke from a coke oven. The apparatus comprises a shed extending along the coke side of the battery having an arched roof and supports for the roof. A longitudinal upright partition within the shed divides it into an entrapment chamber adjacent the battery for containing the emissions, and an expansion chamber extending parallel to and offset laterally from the expansion chamber. The partition comprises a heat shield having one side facing the oven discharge doors and located across the quench car tracks from the doors. Exhaust means for the entrapment chamber comprise a flow restriction defined by the upper end of the partition and the roof for accelerating gases leaving the entrapment chamber so that particulates are entrained and inhibited from settling in the entrapment chamber, and are carried into the expansion chamber where gas velocity is reduced and particulates may settle out of the gas stream. There is a hopper below the expansion chamber for collection of the particulates settling from the expansion chamber, and an exhaust duct extending longitudinally of said shed downstream from said expansion chamber and having openings therein for ingress of gases to be conducted away from the expansion chamber.

The invention is further directed to a method of controlling the emissions caused by pushing of coke from a coke oven. In this method, the coke pushed from the oven is confined in an emission entrapment zone. The emission is passed through a flow restriction at the outlet of the entrapment zone so that the gases contained in the emission are accelerated and particulates are entrained in the gases and inhibited from settling in the entrapment zone. The emission then passes into an expansion zone downstream from the flow restriction within which gas velocity is reduced. The expansion zone includes a settling region laterally offset from and extending below the flow restriction through which substantially the entire mass of the emission is passed and in which particulates settle out along a flow path whose gravity component is in a direction downstream and away from the flow restriction. The particulates are collected as they settle out of the gases and the gases are exhausted from the expansion zone downstream from the settling region.

BRIEF DESCRIPTION OF THE DRAWINGS

Corresponding reference characters indicate corresponding parts throughout the several views of the drawings.

DESCRIPTION OF THE PREFERRED EMBODIMENTS

Figures 1, 4:
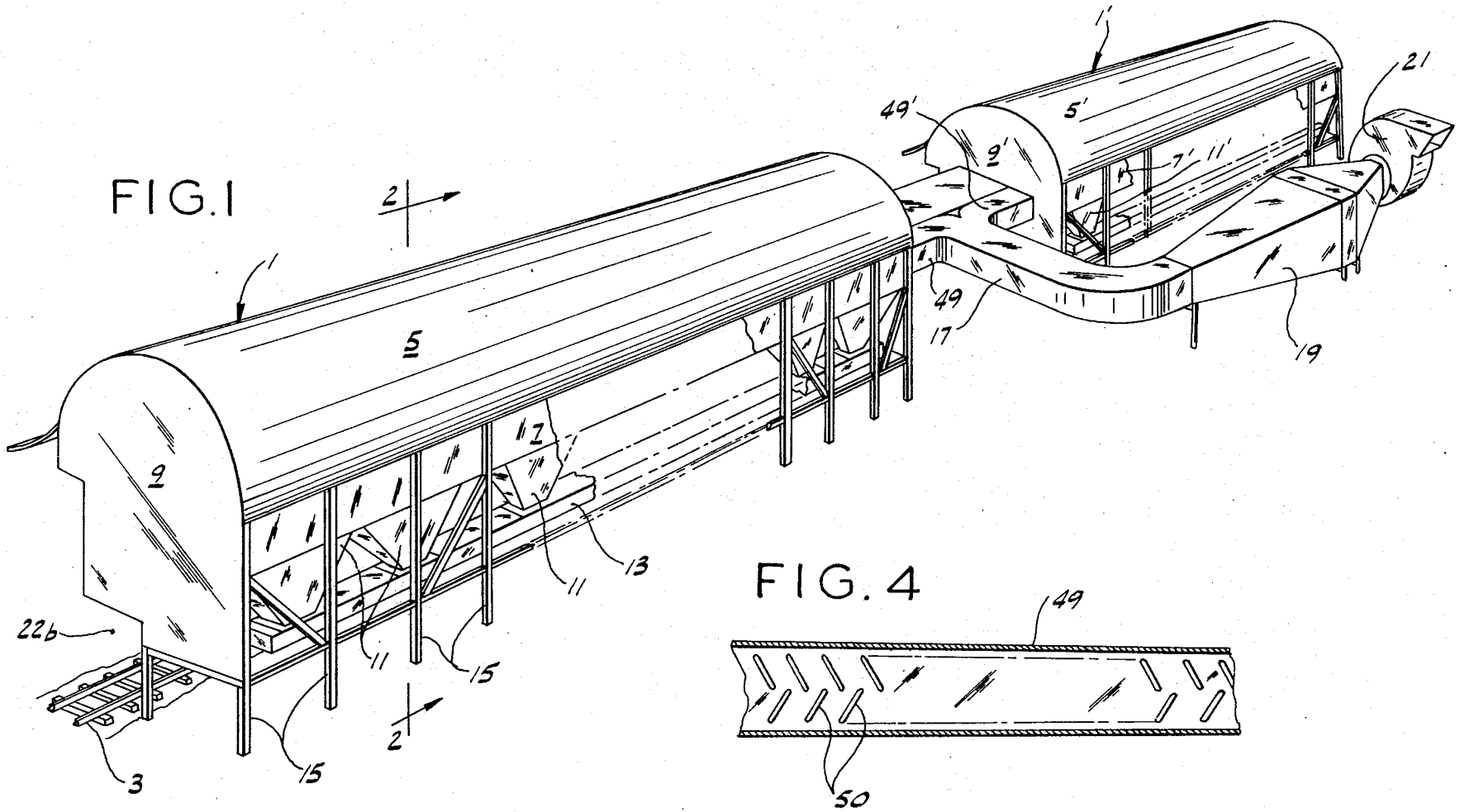
FIG. 1 is an external perspective view of the apparatus of the invention.
FIG. 4 is an enlarged section taken on line 4—4 of FIG. 2, showing details of the exhaust duct for the apparatus of the invention.

Referring to FIG. 1 of the drawings, there are shown two sheds 1 and 1' installed over quench car track 3 on the coke side of a coke oven battery. The emissions caused by the pushing of coke from a coke oven are contained and the relatively heavy particulates of the emissions are collected within these sheds. Externally, the sheds may each be seen to include laterally arched roofs 5 and 5', outer walls 7 and 7', and end walls 9 and 9'. Extending below and inwardly of the lower edges of outer walls 7 and 7' are longitudinal hoppers 11 and 11' within which the solids are collected in the manner described hereinbelow. A separate hopper is provided for each bay of each shed. A conveyor 13 for carrying away solids extends longitudinally below hoppers 11 and 11'. The entire structure is supported by its own steelwork, including side columns shown at 15 in FIG. 1.

Gases are exhausted from sheds 1 and 1' through duct 17, scrubber 19 and blower 21. The capacity of blower 21 is sufficient to maintain both sheds 1 and 1' under a slight negative gauge pressure so that none of the emissions from the ovens in the battery escape to the atmosphere either via the openings **22*a* underneath hoppers 11 and 11' or through the openings 22*b* which are provided in end walls 9 and 9'** for passage of the coke guide and quench car. Because of the negative pressure under which the sheds are maintained, there is a steady influx of ambient air through these apertures into the shed.

Figure 2:
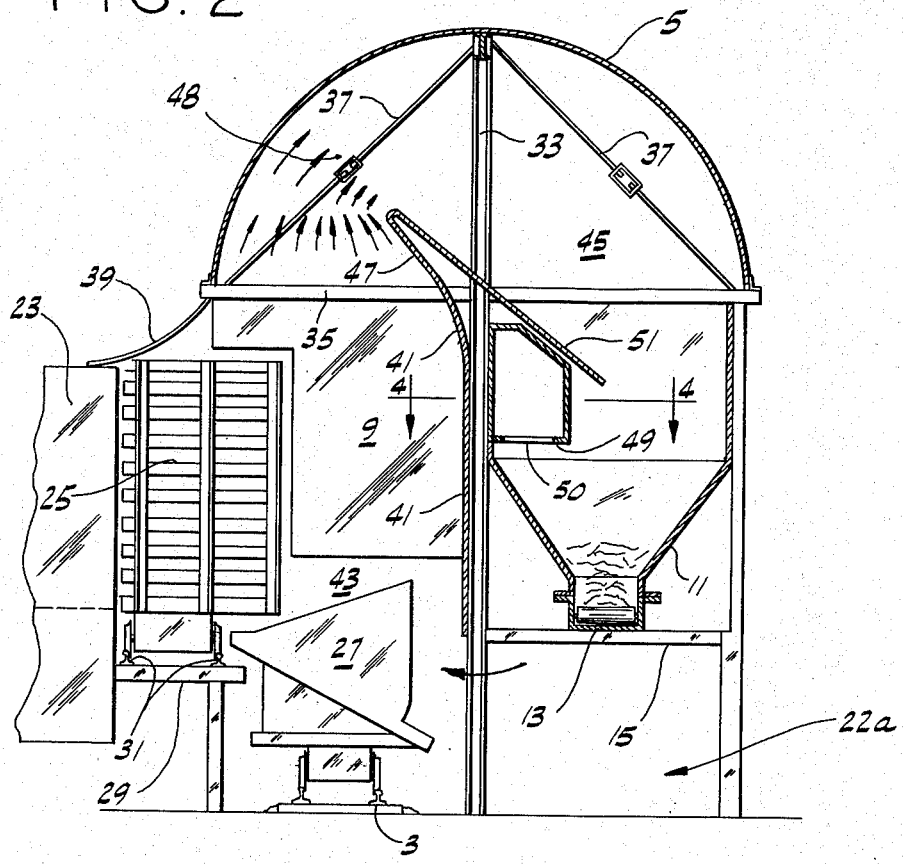
FIG. 2 is a cross-section on line 2—2 of FIG. 1 showing the embodiment of the invention wherein dry particulates are separated from the gases and collected.

FIG. 2 shows the internal arrangement of the shed in the dry recovery embodiment of the invention. Shown at 23 is the discharge end of the coke oven battery. When coke is pushed from an oven, it passes through coke guide 25 into quench car 27 positioned on track 3. The coke guide 25 is supported by dock 29 and is moved from oven to oven along track 31.

Roof 5 and shed 1 extends over track 3 at a level somewhat higher than the tops of the ovens of battery 23, and is supported by columns 33, lateral beams 35 (which are in turn stabilized by rods 37) and outer columns 15. An insulated panel 39 closes the gap between the inward edge of roof 5 and the discharge end of battery 23. A longitudinal upright partition 41 constitutes a heat shield facing the oven discharge doors across the quench car track therefrom, and serves to contain the radiant heat released upon pushing of coke from the oven into the quench car 27. Thus, the partition is either constructed of a heat-resistant material or is lined with such material on the side thereof facing the oven discharge doors. A preferred material of construction is corrugated stainless steel. Because of its exposure to hot gases for a short duration at temperatures in the range of 800°–1,000°F., roof 5 is also constructed of a heat-resistant material such as stainless steel.

Partition 41 also divides shed 1 into an entrapment chamber 43 adjacent battery 23 and an expansion chamber 45 extending parallel to and offset laterally from the entrapment chamber. The emission caused by pushing of coke from an oven is contained by entrapment chamber 43 and the gases and particulates comprising the emission subsequently pass into expansion chamber 45 where gas velocity is reduced and relatively heavy particulates are separated from the gases. Since both the entrapment and expansion chambers extend alongside a plurality of ovens, most preferably along the entire battery, the emission may expand longitudinally in the entrapment chamber and pass over to the expansion chamber without escaping to the surrounding atmosphere.

Roof 5 and a projection 47 at the upper end of partition 41 define a flow restriction 48 in the path of gases moving from entrapment chamber 43 to expansion chamber 45. This flow restriction serves effectively as a capture orifice, causing gases leaving the entrapment chamber to be accelerated so that particulates are entrained in these gases and inhibited from settling in the entrapment chamber. Advantageously, partition 41 is substantially centrally located underneath the vertex of roof 5, and projection 47 is canted toward the portion of the roof nearest battery 23, so that the flow restriction is located in the upwardly directed portion of the flow path of the emission from chamber 43 to chamber 45, and chamber 45 extends along the major portion of the roof. Preferably, projection 47 is canted to such an extent that the plane of the throat (narrowest cross section) of flow restriction 48 is at an angle of approximately 45° to the vertical. Such location of the flow restriction minimizes the fallout of particulates in chamber 43 by causing acceleration of gases in a region relatively close to the zone in which the coke is discharged.

Because shed 1 is maintained under slight negative gauge pressure, ambient air is drawn into the entrapment chamber through the openings in end walls 9 and below partition 41. This ambient air not only provides ventilation for the working areas on the discharge side of the ovens but also assist in entrainment of particulates in the entrapment chamber. Thus, longitudinal expansion of the emission within the entrapment chamber occurs without consequent fallout of particulates. The smooth internal contour and trussless support of arched roof 5 affords a streamlined flow path for gases passing from entrapment chamber 43 to expansion chamber 45, thus further minimizing the tendency for particulates to recirculate and fall out in the entrapment chamber.

Expansion chamber 45 extends downstream from and below the level of flow restriction 48. In the expansion chamber, gas velocity is reduced due to the combined effect of increased flow cross-section and cooling of the gases by heat loss through roof 5. As a result of the reduced gas velocity, relatively heavy particulates (normally those of greater than 1 $\mu$ particle size) separate from the gases in a settling region which is laterally offset from said flow restriction within the expansion chamber. The separating particles fall out of the gases along a settling path whose gravity component is, in this preferred embodiment of the invention, in a direction entirely downstream from the entrapment chamber. The preferred location of the flow restriction shown in the drawings affords a relatively large volume and long flow path within the expansion chamber as compared to the entrapment chamber, thus assuring that the gas cooling, velocity reduction and particulate settling are practically entirely confined to the expansion chamber rather than the entrapment chamber.

Particulates separating from the gases in the settling region of the expansion chamber fall into solids collection hoppers 11, while the gases and submicron particulates pass into an exhaust duct 49 extending along the entire length of the shed downstream of the expansion chamber along the back side of partition 41. An important feature of the invention is the series relationship of the flow restriction, the settling region of chamber 45 and exhaust duct 49. Because of this orientation, substantially the entire mass of the emission passes through the settling region. This relationship thus assures that essentially all the separating particulates fall out of the gases in a region remote from the entrapment chamber along gravity paths downstream therefrom, and further affords positive collection of the particulates in hoppers 11.

FIG. 4 shows the preferred shape and orientation of the apertures 50 for ingress of gases into duct 49, i.e., a staggered herringbone pattern which assists in the separation of any moisture entrained in the gas. This feature is of particular importance in the wet separation embodiment of the invention depicted in FIG. 3 and described hereinbelow. Entrained moisture tends to collect at and run off the edges of the apertures, thus reducing the extent of moisture removal required in the exhaust system downstream of duct 49.

In order to minimize the entrainment of heavy particulates into duct 49, the apertures 50 for gas ingress are preferably located in the bottom wall of the duct. A deflector panel 51, extending outwardly and downwardly from the upper end of partition 41, forms the inside wall of the expansion chamber and directs particulates toward the hoppers 11. This deflector is also preferably constructed of stainless steel to provide a smooth surface along which particulates may slide. Particulates striking panel 51 thus flow off the panel and accumulation of solids on the panel surface is avoided.

At the end of the shed, duct 49 is connected to duct 17 as shown in FIG. 1. Within the shed, duct 49 is tapered to provide substantially constant velocity at all points therein. Thus, the cross-sectional area of the duct constantly increases from the end of the shed opposite duct 17 approximately to the point where duct 49 and duct 17 are joined. Also the duct is sized for a pressure drop low enough for gas flow through the flow restriction to be substantially the same along the entire length of the shed, but for a velocity high enough to avoid significant settling of submicron particles within the duct. A velocity of about 4,000 fpm is satisfactory for these purposes.

Solids collected in hopper 11 are discharged into conveyor 13 extending longitudinally therebelow. The conveyor is operated intermittently to carry away the solids for disposal.

Figure 3:
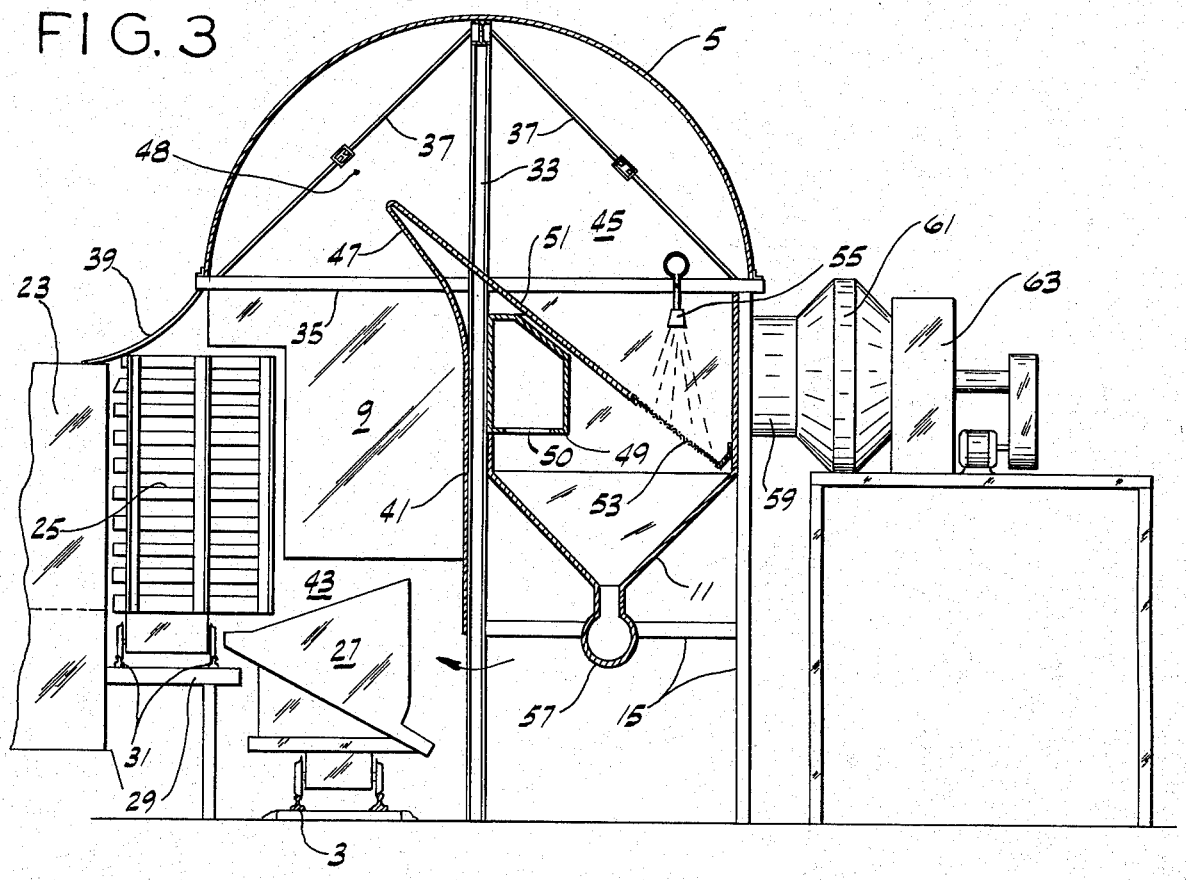
FIG. 3 is a view similar to FIG. 2 but showing an alternative wet system for separation and recovery of the particulates.

Referring now to FIG. 3, the construction of the shed in a wet collection system is substantially the same as that for the dry, except that precipitation means 53 is located at a level below and downstream of the flow restriction and above and upsteam of the solids receiving hoppers 11, typically between the settling region and the hoppers. Means 53 comprises a frame holding a screen or grid, and extends outwardly and downwardly from the outer edge of panel 51 to wall 7. A high pressure water source comprising jets 55, located in the settling region of expansion zone 45, is directed toward means 53. Impingement of water from these jets onto the screen or grid causes the solid particulates to be trapped and collected. The water jets serve the further purpose of driving the particulates through the screen or grid or means 53 and maintaining it clean and free from pluggage. A slurry containing the solid particulates flows off the lower side of means 53 into collection hoppers 11 from whence it passes through conventional gooseneck seals into a slurry discharge header 57.

The arrangement in the wet system differs from that shown in FIG. 1 since scrubber 19 is not needed. The gases leaving the wet system thus pass through duct 49 into an external discharge duct 59, mist eliminator 61 and blower 63.

The apparatus described above constitutes a uniquely advantageous system for controlling the emissions produced by pushing of coke from a coke oven. Although other structural arrangements could be utilized, this apparatus is uniquely suited for carrying out the method of the invention for controlling such emissions. In accordance with this method, coke is pushed from a coke oven into an emission entrapment zone. This zone is preferably maintained under negative gauge pressure by a system exhaust blower (such as shown at 21 in FIG. 1 and 63 in FIG. 3), with access provided to the surroundings for ingress of air at a linear velocity in the range of 50–75 ft./min. The emission from the coke is passed through a flow restriction at the outlet of the entrapment zone so that the gases contained in the emission are accelerated and particulates are entrained in the gases and thus inhibited from settling in the entrapment zone. The dimensions of the flow restriction are subject to some variation but the restriction is preferably sized so that air and gases pass through the flow restriction at a velocity of at least about 100 ft./min.

Downstream of the flow restriction, the emission is passed into an expansion zone where gas velocity is reduced. Preferably, the cross-sectional area of the flow path in the expansion zone is sufficient so that the flow velocity based on ambient air flow is reduced to no greater than 40–50 ft./min. The gas is also cooled in the expansion zone so that velocity is further reduced. In the apparatus of the invention, for example, substantial cooling results from loss of heat to the atmosphere through the roof area over the expansion zone.

The expansion zone includes a settling region laterally offset from and extending below the level of the flow restriction through which substantially the entire mass of the emission is passed and within which particulates settle out along a flow path whose gravity component is in a direction downstream from and away from the flow restriction. Thus, return of particulates to the entrapment zone is positively prevented. The relatively heavy particulates settling out of the gas stream are collected and the gases are exhausted from the expansion zone.

In contrast to previously available systems for controlling emissions caused by the pushing of coke from coke ovens, the apparatus and method of the invention provide positive control of the emission without significant fallout of particulates on the quench car track or working areas on the discharge side of the ovens. The apparatus and method of the invention also provide for positive collection of solids and removal thereof by automated processes. Thus, the hazardous and dirty manual tasks involved in the removal of solids from other emission control systems are avoided in the system of this invention. For this reason and because there are no hoods to concentrate noxious gases in the working area, a material contribution is made to the safety and comfort of those working on the discharge side of the oven.

Although a relatively large ambient air flow is required to maintain the preferred velocities referred to above, the exhaust blower power demand is relatively low since only a low energy scrubber is needed to remove fine particulates carried out of the shed in the exhaust air and gas stream. Thus, the overall power requirement may be considerably lower than that of a traveling hood which is positioned at only a single oven at a time. The absence of traveling hoods also avoids any encumbrance on the movement of coke guide or quench car, and further avoids the high capital costs and maintenance expense required for such hoods.

Maintenance problems are still further reduced because of the capability of this system for collecting fumes from leaking door seals and, in the preferred embodiment of the invention wherein the upper end of the partition 41 is canted toward the portion of the roof nearest the battery, the highest ambient air velocity is directly adjacent the doors so that noxious gases are rapidly and cleanly swept out of the area. Since the emission control apparatus is supported by its own steel, its weight does not bear on the ovens, a feature of significant practical importance where an installation is made alongside an existing battery.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. Apparatus installed over the quenching car tracks on the coke side of a coke oven battery for controlling emissions caused by pushing of coke from a coke oven, said apparatus comprising a shed extending along the coke side of said battery having a laterally arched roof and supports for said roof, a longitudinal upright partition within said shed dividing the shed into an entrapment chamber adjacent said battery for containing the emission and an expansion chamber extending parallel to and offset laterally from the entrapment chamber, said partition comprising a heat shield having one side facing the oven discharge doors and located across the quench car tracks from said doors, exhaust means for said entrapment chamber comprising a flow restriction defined by the upper end of said partition and said roof for accelerating gases leaving the entrapment chamber so that particulates are entrained, inhibited from settling in said entrapment chamber, and carried into said expansion chamber where gas velocity is reduced and particulates may settle out of the gas stream, a hopper below said expansion chamber for collection of the particulates settling out in said expansion chamber, and an exhaust duct extending longitudinally of said shed downstream from said expansion chamber and having openings therein for ingress of gases to be conducted away from said expansion chamber.

2. Apparatus as set forth in claim 1 wherein said partition is substantially centrally located underneath the vertex of said arched roof and the upper portion of said heat shield includes a projection canted toward the portion of said roof nearest said battery so that said flow restriction is located in the upwardly directed portion of the gas flow path and said expansion chamber extends along a major portion of said roof.

3. Apparatus as set forth in claim 2 wherein said projection is canted to such an extent that the plane of the throat of said flow restriction is at an angle of approximately 45° to the vertical.

4. Apparatus as set forth in claim 1 wherein said duct is tapered to provide a substantially constant velocity therein all along said expansion chamber.

5. Apparatus as set forth in claim 1 further comprising a conveyor below said hoppers for removal of solids therefrom.

6. Apparatus as set forth in claim 1 wherein said duct extends along the back side of said partition.

7. Apparatus as set forth in claim 6 further comprising a deflector panel extending outwardly and downwardly from the upper end of said partition for deflection of particulates away from said duct toward said hopper.

8. Apparatus as set forth in claim 1 further comprising precipitation means between said settling region and said solids receiving means, and means for impingement of water on said precipitation means whereby the particulates are trapped and collected as a slurry flowing into said solids receiving means.

9. Apparatus as set forth in claim 1 further comprising a blower on the downstream end of said exhaust duct for drawing gases through said duct and maintaining said shed under slight negative gauge pressure.

10. Apparatus as set forth in claim 9 wherein said entrapment chamber has openings therein for ingress of ambient air.

* * * * *